US008215372B2

(12) United States Patent
Anglin

(10) Patent No.: US 8,215,372 B2
(45) Date of Patent: Jul. 10, 2012

(54) METHOD AND APPARATUS FOR CONSUMABLE-PATTERN CASTING

(75) Inventor: Willie R. Anglin, Burnsville, NC (US)

(73) Assignee: BRP US Inc., Sturtevant, WI (US)

( * ) Notice: Subject to any disclaimer, the term of this patent is extended or adjusted under 35 U.S.C. 154(b) by 0 days.

(21) Appl. No.: 12/811,964

(22) PCT Filed: Oct. 17, 2008

(86) PCT No.: PCT/US2008/080286

§ 371 (c)(1),
(2), (4) Date: Jul. 7, 2010

(87) PCT Pub. No.: WO2010/044800

PCT Pub. Date: Apr. 22, 2010

(65) Prior Publication Data

US 2011/0180227 A1 Jul. 28, 2011

(51) Int. Cl.
*B22D 19/00* (2006.01)
*B22C 9/04* (2006.01)
*B22C 9/10* (2006.01)

(52) U.S. Cl. ..... 164/9; 164/34; 164/44; 164/98; 164/112; 164/369

(58) Field of Classification Search ..... 164/34, 164/35, 44, 45, 9, 98, 112, 369, 397, 398
See application file for complete search history.

(56) References Cited

U.S. PATENT DOCUMENTS 4,066,115 A * 1/1978 Ohtani et al. ..... 164/9
4,285,385 A * 8/1981 Hayashi et al. ..... 164/9
5,853,044 A * 12/1998 Wheaton et al. ..... 164/516
7,216,689 B2 * 5/2007 Verner et al. ..... 164/45
2007/0044933 A1 3/2007 Santeler

FOREIGN PATENT DOCUMENTS

| | | |
|---|---|---|
| CN | 1039546 | 2/1990 |
| EP | 1759788 A2 | 3/2007 |
| EP | 2000232 A1 | 12/2008 |
| JP | 55005151 | 1/1980 |

OTHER PUBLICATIONS

International Search Report of PCT/US2008/080286; Jun. 24, 2009; Michel Scheid.
English translation of CN1039546, Schwarb Foundry, Inc., Feb. 14, 1990.

* cited by examiner

*Primary Examiner* — Kevin P Kerns
(74) *Attorney, Agent, or Firm* — Osler, Hoskin & Harcourt LLP

(57) ABSTRACT

A method of making a casting is disclosed. At least one support member has at least one first portion and a plurality of second portions connected to a mold core. The mold core is positioned at least in part in a sealed interior volume of a negative mold. The first portion is positioned outside the interior volume. The second portions are positioned at least in part inside the interior volume. A consumable pattern material is introduced into the negative mold to create a consumable pattern. The support member is disposed at least in part outside the consumable pattern. The consumable pattern is removed from the negative mold. A shell is formed around the consumable pattern. A casting material is introduced into an interior of the shell to create a final casting. The support member is disposed at least in part outside the final casting. A mold core is also described.

17 Claims, 10 Drawing Sheets

METHOD AND APPARATUS FOR CONSUMABLE-PATTERN CASTING

FIELD OF THE INVENTION

The present invention relates to a method and apparatus for consumable-pattern casting, in particular casting a component with a mold core.

BACKGROUND OF THE INVENTION

Some components of vehicles, such as fuel cells, generate heat during normal operation, and require adequate cooling to dissipate the heat. One way of providing cooling is by way of a cooling plate containing a passage through which water or other coolant flows. The coolant is then pumped to an external heat exchanger to dissipate the heat absorbed by the coolant to the atmosphere. It is desired to maximize the coolant flow through the plate, and to maximize thermal contact between the coolant and the heat source. As a result, it is desired to produce a relatively thin cooling plate containing a relatively large-diameter tube with a serpentine shape.

One possible construction for these cooling plates is a curved tubular steel mold core inside a cast aluminum plate, and subsequently machined to produce the final shape of the cooling plate.

One method of molding cooling plates is by using a consumable-pattern casting method, such as lost-foam casting or lost-wax casting. Consumable-pattern casting allows the casting of parts with a more complex and more precise shape, which requires less machining to achieve the desired shape. However, this method presents difficulties with the positioning of the tubular core. A long, serpentine-shaped tube is desired to increase thermal contact with the coolant. This serpentine shape is prone to warping and deforming from the heat of the molten aluminum when it is poured into the mold, particularly in applications requiring a thin cooling plate and a correspondingly thin tube. The warping may create obstructions to coolant flow through the core, and may obstruct the flow of molten aluminum through the mold and prevent the aluminum from completely filling the mold. The warping may also cause the core to bend away from the central plane of the cooling plate. Due to the relative thinness of the cooling plate and thickness of the core, even small deviations from the plane result in the core being very near the surface of the cooling plate, in which case the core may be perforated during subsequent machining of the face of the cooling plate, rendering the casting unusable. In these cases, the cooling plate must be scrapped, resulting in added cost and waste of materials.

Referring to FIG. 1, one method of remedying this problem is to affix one or more support bars 10 directly to a serpentine tube 12 as shown in FIG. 1, to create a mold core 14 having increased rigidity to maintain its position and shape during the casting process. One drawback of this method is that the support bars 12 can obstruct the flow of molten aluminum through the mold and create porosity defects in the final casting. The resulting porosity defects can render the casting unusable, resulting in added cost and waste of materials. In addition, this method offers only limited support for the mold core, and it is still possible for the mold core to shift position away from the central plane of the cooling plate, resulting in the machining difficulties described above.

Therefore, there is a need for a method of manufacturing a consumable-pattern casting having reduced incidences of deformities in a tubular mold core, and reduced incidences of porosity defects.

SUMMARY OF THE INVENTION

It is an object of the present invention to ameliorate at least some of the inconveniences present in the prior art.

In one aspect, the invention provides a method of making a casting using a mold core and at least one support member. The at least one support member has at least one first portion and a plurality of second portions. The plurality of second portions is connected to the mold core. The method comprises: positioning the mold core at least in part in a sealed interior volume of a negative mold; positioning the at least one first portion of the at least one support member outside the interior volume; positioning the plurality of second portions at least in part inside the interior volume; introducing a consumable pattern material into the interior volume of the negative mold to create a consumable pattern, the mold core being disposed at least in part inside the consumable pattern, the at least one support member being disposed at least in part outside the consumable pattern; removing the consumable pattern from the negative mold; forming a shell around the consumable pattern; and introducing a casting material into an interior of the shell to create a final casting. The mold core is disposed inside the final casting. The at least one support member is disposed at least in part outside the final casting.

In a further aspect, the at least one first portion is at least one elongate member. The plurality of second portions is a plurality of linking members connected to the elongate member.

In a further aspect, the method comprises forming the mold core from at least one hollow tube by forming at least one curved portion in the hollow tube; connecting a first end of each of the one or more linking members to the at least one elongate member; and connecting a second end of each of the one or more linking members to a corresponding one of the at least one curved portion of the mold core.

In a further aspect, the mold core includes at least one hollow tube.

In a further aspect, the mold core includes stainless steel.

In a further aspect, the casting material includes aluminum.

In a further aspect, the at least one tube has a plurality of first curved portions and a plurality of second curved portions. The at least one support member includes first and second support members. The plurality of second portions of the first support member is a plurality of first linking members connected to corresponding ones of the first curved portions. The plurality of second portions of the second support member is a plurality of second linking members connected to corresponding ones of the second curved portions.

In a further aspect, the plurality of first curved portions and the plurality of second curved portions lie in a common plane.

In a further aspect, connecting the first and second linking members to the first and second curved portions comprises welding the first and second linking members to the first and second curved portions.

In a further aspect, the negative mold has a parting plane. Positioning the mold core in the negative mold includes aligning the common plane with the parting plane.

In a further aspect, the at least one tube has a plurality of first curved portions and a plurality of second curved portions. The at least one support member includes first and second support members. The first support member is an elongate first member. The at least one first portion of the first support member is a plurality of spaced-apart first co-axial portions. The plurality of second portions of the first support member is a plurality of first linking portions intermediate the plurality of first co-axial portions. The plurality of first linking portions extends away from an axis of the first co-axial portions. Each first linking portion is connected to a corresponding one of the plurality of first curved portions. The second support member is an elongate second member. The at least one first portion of the second support member is a plurality of spaced-apart second co-axial portions. The plurality of second portions of the second support member is a plurality of second linking portions intermediate the plurality of second co-axial portions. The plurality of second linking portions extends away from an axis of the second co-axial portions. Each second linking portion is connected to a corresponding one of the plurality of second curved portions. Positioning the plurality of first portions of the at least one support member outside the interior volume comprises positioning at least the plurality of first co-axial portions and the plurality of second co-axial portions outside the interior volume.

In a further aspect, the consumable pattern material is wax. Forming the shell around the consumable pattern comprises coating the consumable pattern with a refractory material.

In a further aspect, the consumable pattern material is foam. Forming the shell around the consumable pattern comprises coating the consumable pattern with a refractory material and compacting sand around the consumable pattern.

In a further aspect, the method further comprises sealing the sealed interior volume with a heat-resistant sealing material prior to introducing the consumable pattern material.

In a further aspect, sealing the consumable pattern with a heat-resistant sealing material comprises at least partially enclosing the at least one support member inside the heat-resistant sealing material.

In a further aspect, the heat-resistant sealing material contains silicone.

In a further aspect, the method further comprises detaching the at least one support member from the final casting.

In an additional aspect, the invention provides a mold core assembly comprising a tube having a plurality of first curved portions and a plurality of second curved portions. A plurality of first linking members is connected to the plurality of first curved portions. A first support member is connected to the plurality of first linking members. A plurality of second linking members is connected to the plurality of second curved portions. A second support member is connected to the plurality of second linking members.

In a further aspect, the tube is a hollow tube having an inlet and an outlet.

In a further aspect, a length of the tube is greater than a distance between the inlet and the outlet.

In a further aspect, the one or more linking members and the support member lie in a common plane.

In an additional aspect, the invention provides a mold core assembly comprising a tube having a plurality of first curved portions and a plurality of second curved portions. A first support member has a plurality of generally co-axial spaced apart first portions. A plurality of first linking portions is intermediate the plurality of spaced-apart first portions. The plurality of first linking portions extends away from an axis of the first portions. Each first linking portion is connected to a corresponding one of the plurality of first curved portions. A second support member has a plurality of generally co-axial spaced apart second portions. A plurality of second linking portions is intermediate the plurality of spaced-apart second portions. The plurality of second linking portions extends away from an axis of the second portions. Each second linking portion is connected to a corresponding one of the plurality of second curved portions.

For purposes of this application, the term "chaplet" means a support used to support a mold core during the casting process.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
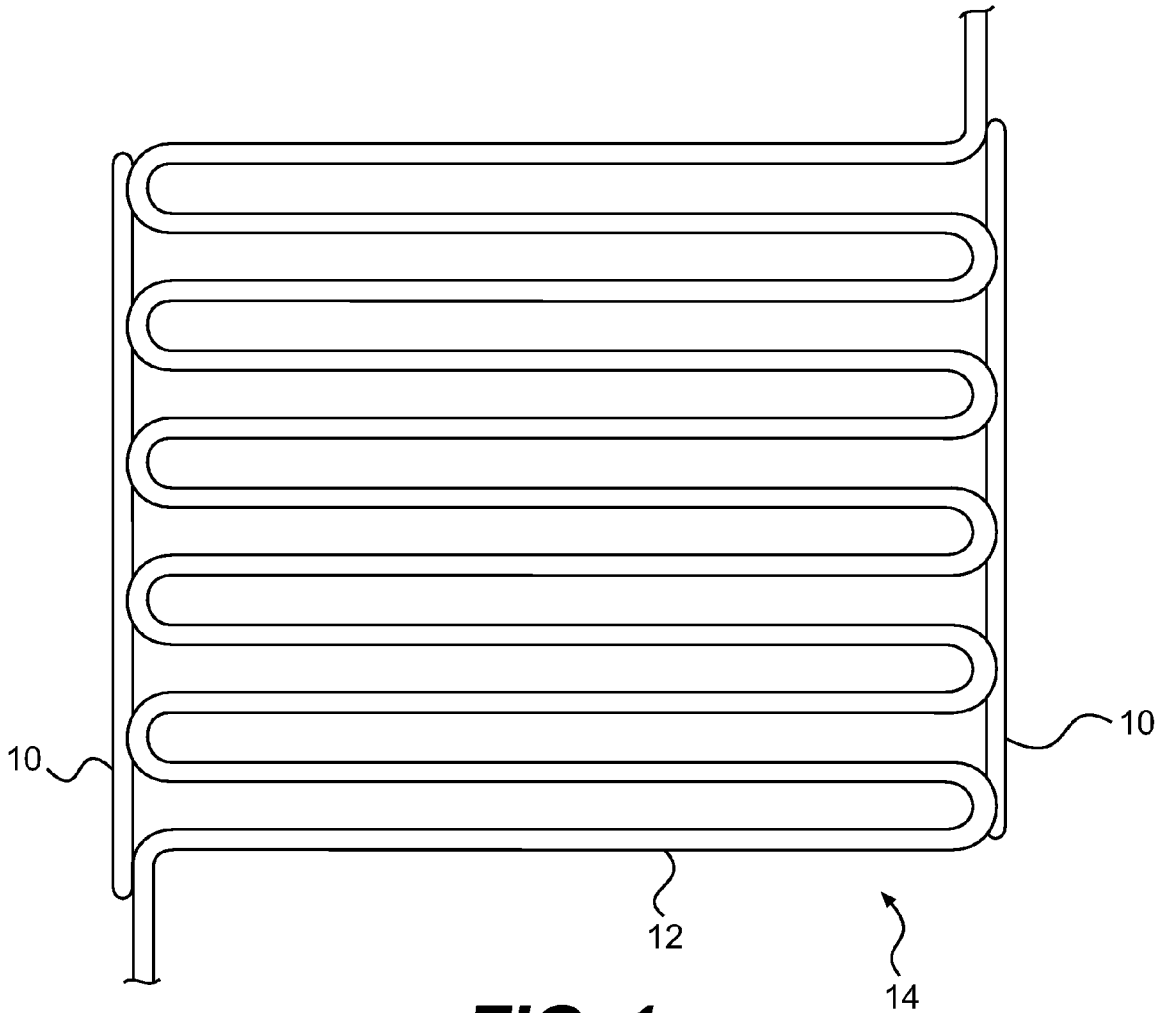
FIG. 1 PRIOR ART
FIG. 1 is a plan view of a prior art mold core assembly.
Figure 2:
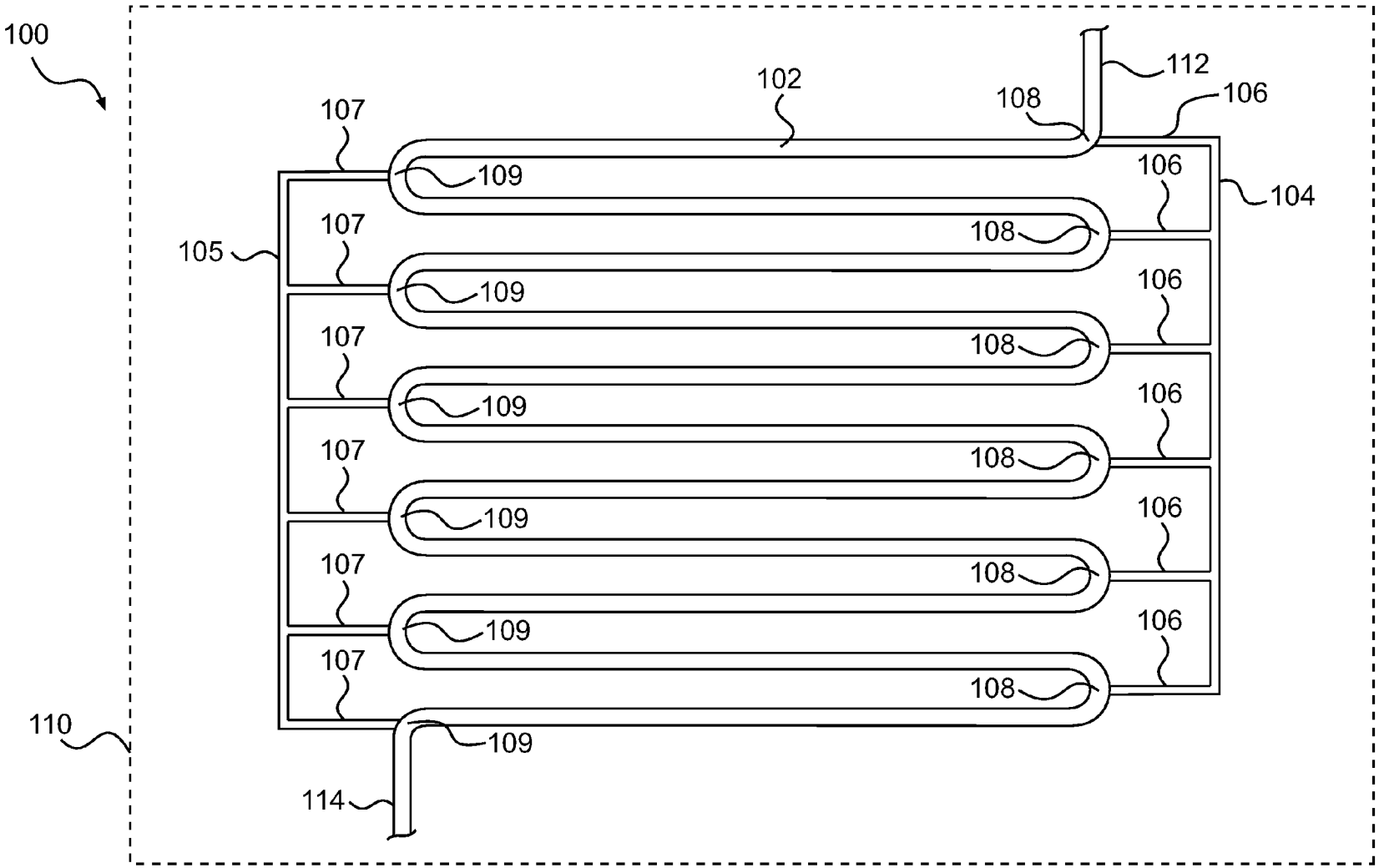
FIG. 2 is a plan view of a mold core assembly according to a first embodiment.

FIG. 2 shows a mold core 100 that can be used in a cooling plate in accordance with a first embodiment.

The mold core 100 consists of a hollow tube 102, preferably made of stainless steel and preferably having an outer diameter of about 6 mm. Other materials and dimensions are contemplated, depending on the specific application for which the casting is intended. The tube 102 is shaped by forming a number of curved portions 108, 109 therein. The curved shape of the tube 102 allows the length of the tube 102 inside the cooling plate to be many times longer than the longest dimension of the cooling plate, and in particular is longer than the distance (measured in a straight line) from the inlet 112 to the outlet 114. A first support member includes a steel support bar 104 welded to a first set of linking members in the form of steel chaplets 106. The first support member is welded to a first set of curved portions 108 of the tube 102. A second support bar 105 is welded to a second set of chaplets 107, which in turn are welded to a second set of curved portions 109 of the tube 102. The first and second curved portions 108, 109 preferably lie in a common plane 110 (parallel to the page of FIG. 2), which will have the same orientation as the final casting. It is preferred that each curved portion 108, 109 be fixedly connected to its corresponding support bar 104, 105, to ensure its stability against deformation during the casting process that will be described below in further detail. The inlet 112 and the outlet 114 fluidly communicate through the hollow interior of the tube 102 to allow for coolant flow therethrough. While the tube 102 is has a generally circular cross-section, it is contemplated that other cross-sectional shapes may be used, such as a square cross-section. It is further contemplated that a solid tube may be used instead of a hollow tube, in which case the tube may be oxidized and removed from the final casting to create a curved channel.

Referring now to FIGS. 3-9, a method will be described of manufacturing a cooling plate by consumable-pattern casting, specifically by lost-foam casting.

Figure 3:
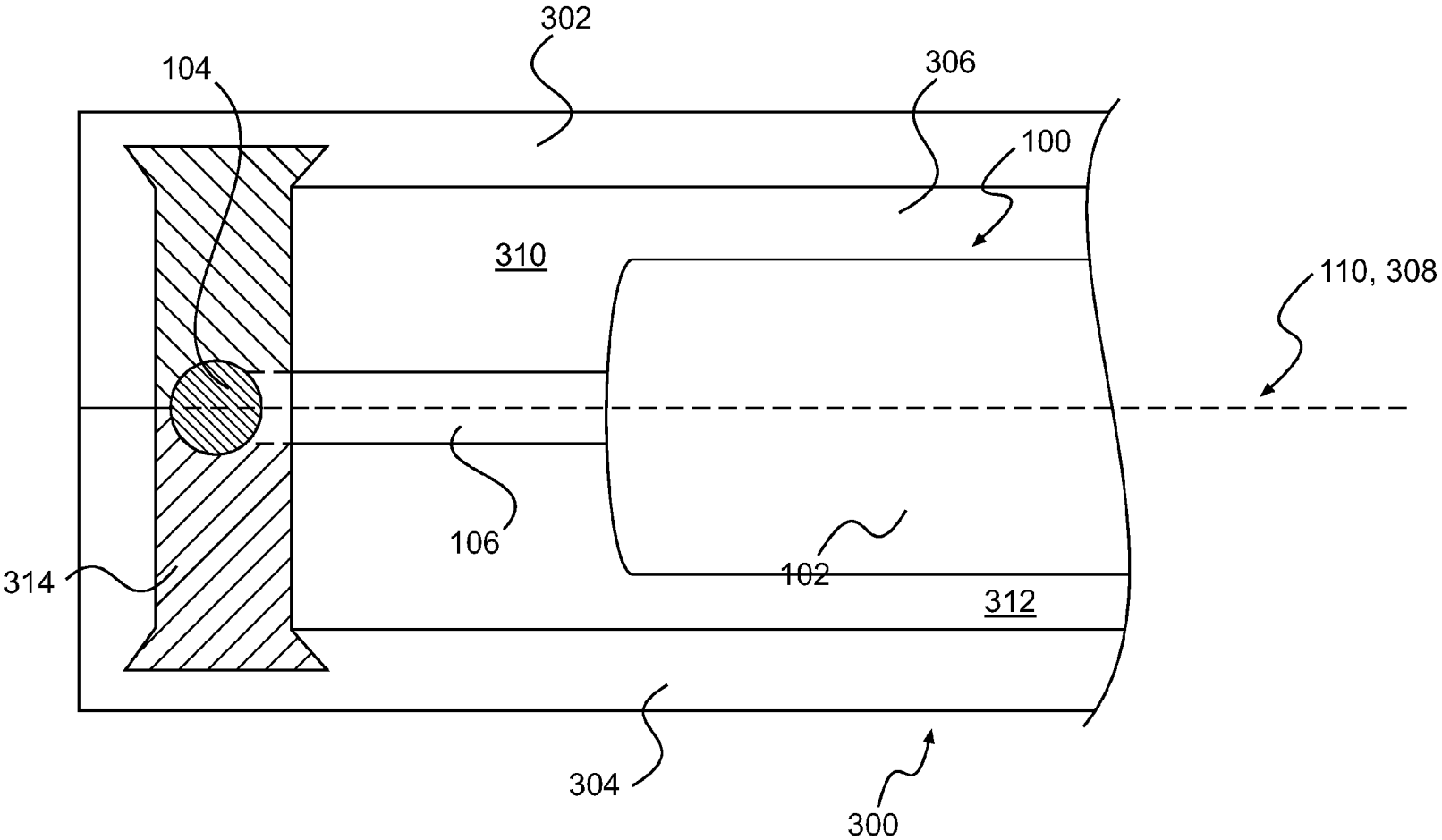
FIG. 3 is a partial cross-sectional view of a consumable pattern inside a negative mold.

Referring to FIG. 3, the mold core 100 is positioned between two halves 302, 304 of a negative mold 300. The two halves 302, 304 mate at a parting plane 308 to define an interior volume 306 of the negative mold 300 that corresponds to the desired shape of the final casting. The interior volume 306 preferably has a thickness of about 8 mm, corresponding approximately to the thickness of the final casting. It should be understood that the dimensions may vary depending on the specific application for which the casting is intended. The mold core 100 is positioned by retaining the support bars 104, 105, or alternatively the chaplets 106, 107, such that the common plane 110 is generally coplanar with the parting plane 308. When the mold core 100 is positioned, most of the mold core 100 is disposed inside the interior volume 306. The inlet 112 and outlet 114 of the mold core 100 and the support bars 104 are outside the interior volume 306 of the negative mold 300.

A consumable pattern material, in the form of beads of polystyrene foam 310, is injected into the interior volume 306 to form a consumable pattern in the form of a foam pattern 312. The interior volume 306 is preferably sealed to prevent the foam 310 from escaping during the injection process, for example by providing a seal 314 around the perimeter of the interior volume 306. The seal 314 is preferably made from a heat-resistant silicone material, but could alternatively be made of any other suitable material. The interior volume 306 may alternatively be sealed by providing a high-precision interface between the mold halves 302, 304 at the parting plane 308. The seal 314 encloses the support bars 104, 105. It is contemplated that the seal 314 may alternatively only partially enclose the support bars 104, 105, or may alternatively be disposed between the interior volume 306 and the support bars 104, 105.

Figure 4:
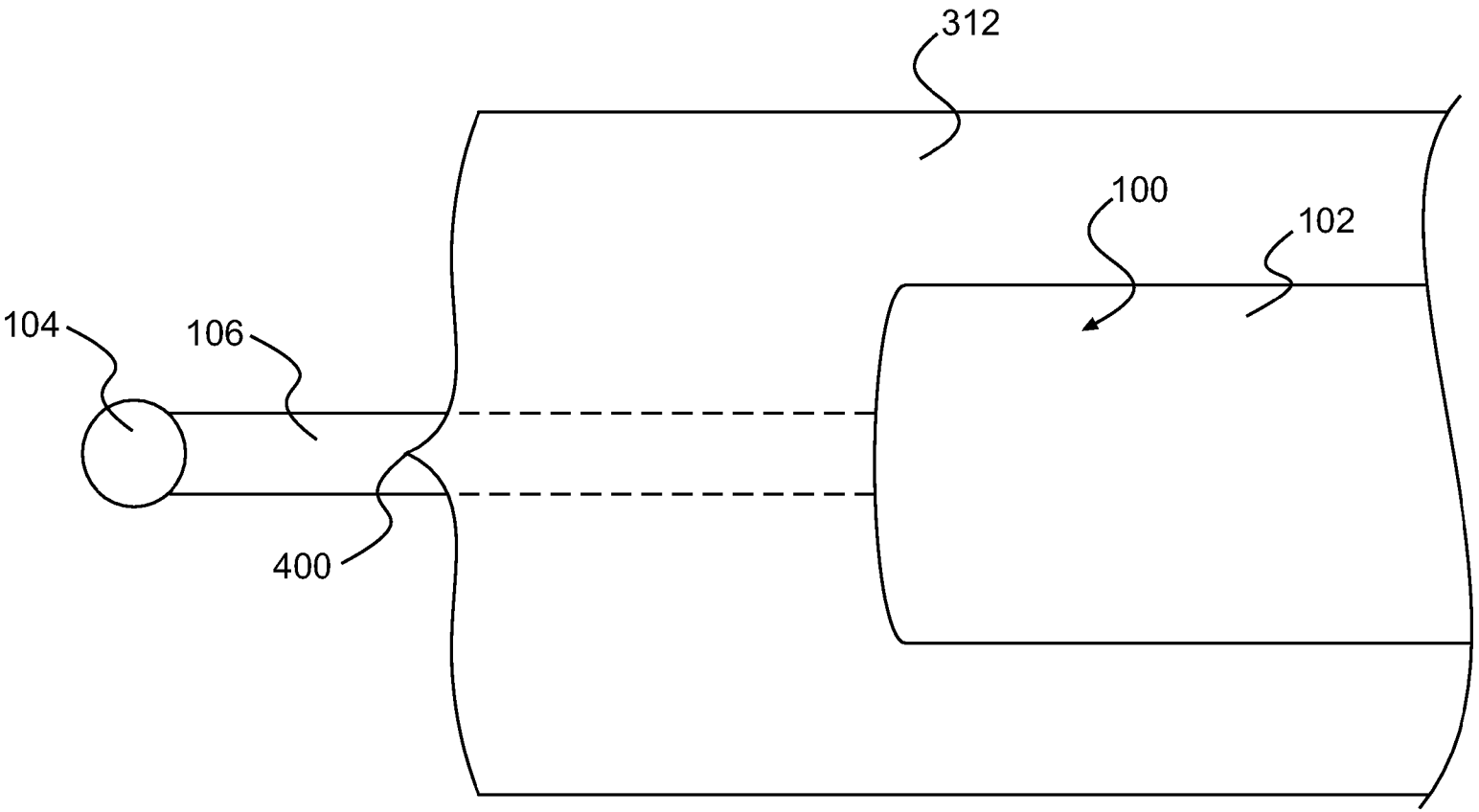
FIG. 4 is a partial cross-sectional view of the consumable pattern of FIG. 3 with the negative mold removed.

Referring now to FIG. 4, the mold halves 302, 304 are separated along the parting plane 308 to remove the foam pattern 312 from the negative mold 300. The majority of the mold core 100 is disposed inside the foam pattern 312. The inlet 112 and outlet 114 of the mold core 100 extend outside the foam pattern 312. The support bars 104, 105 are also disposed outside the foam pattern 312. The foam pattern 312 will have a parting line 400 corresponding to the parting plane 308 of the negative mold 300. As this feature is generally not desired as part of the final casting, the parting line 400 may be removed from the foam pattern 312 by any suitable method, such as by cutting or sanding.

Figure 5:
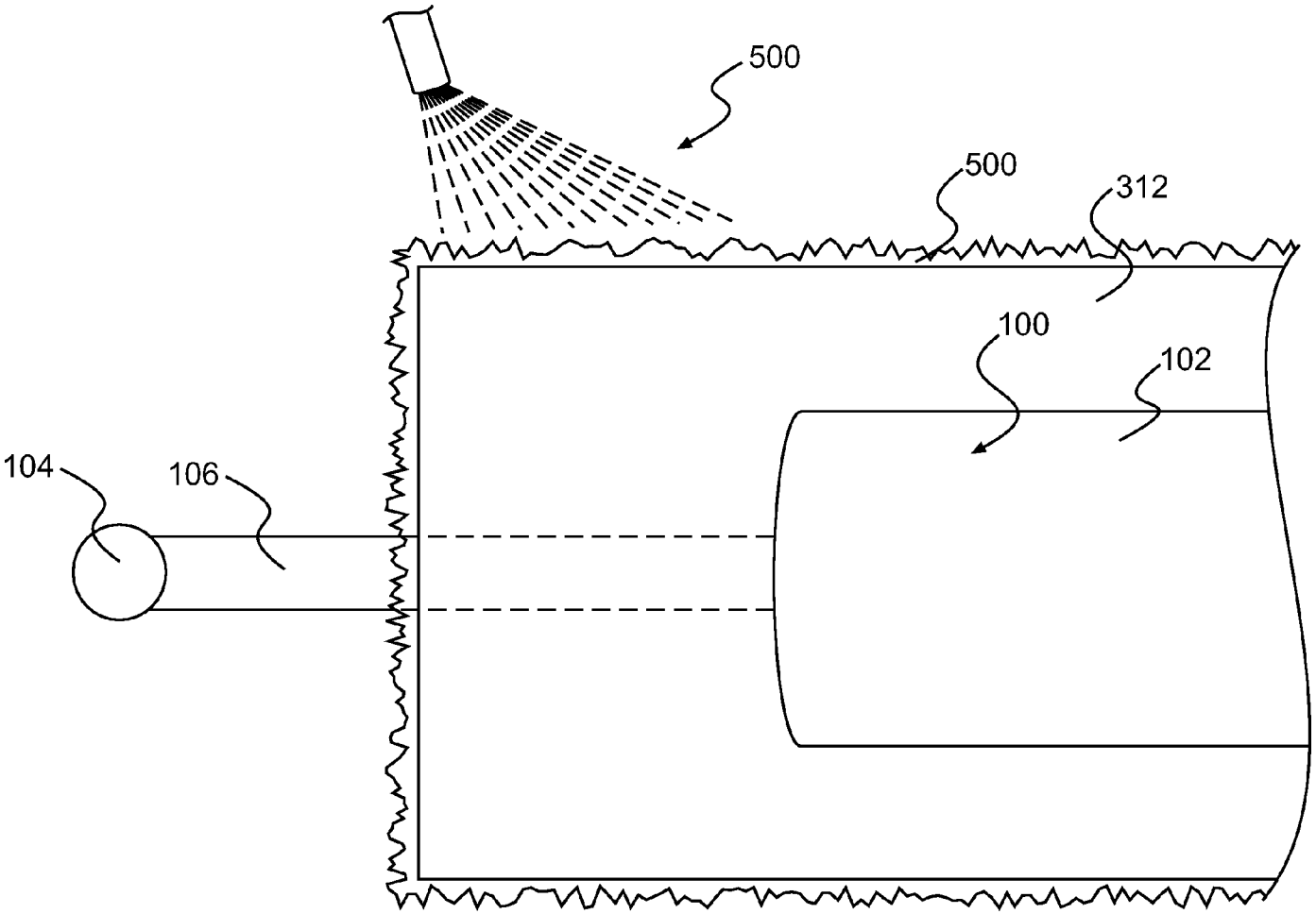
FIG. 5 is a partial cross-sectional view of the consumable pattern of FIG. 3 being coated with a refractory material.

Referring now to FIG. 5, the foam pattern 312 is optionally coated with a refractory material 500, by any suitable method such as dipping the foam pattern 312 in the refractory material 500 or spraying the refractory material 500 onto the foam pattern 312. The coated foam pattern 312 is then heated to a temperature below the melting point of the foam pattern 312. The resulting refractory material 500 is approximately 3-5 mils (0.08-0.13 mm) thick and permeable to foam vapor, for reasons that will be described below in further detail. The purpose of the refractory material 500 will be explained below in further detail.

Figure 6:
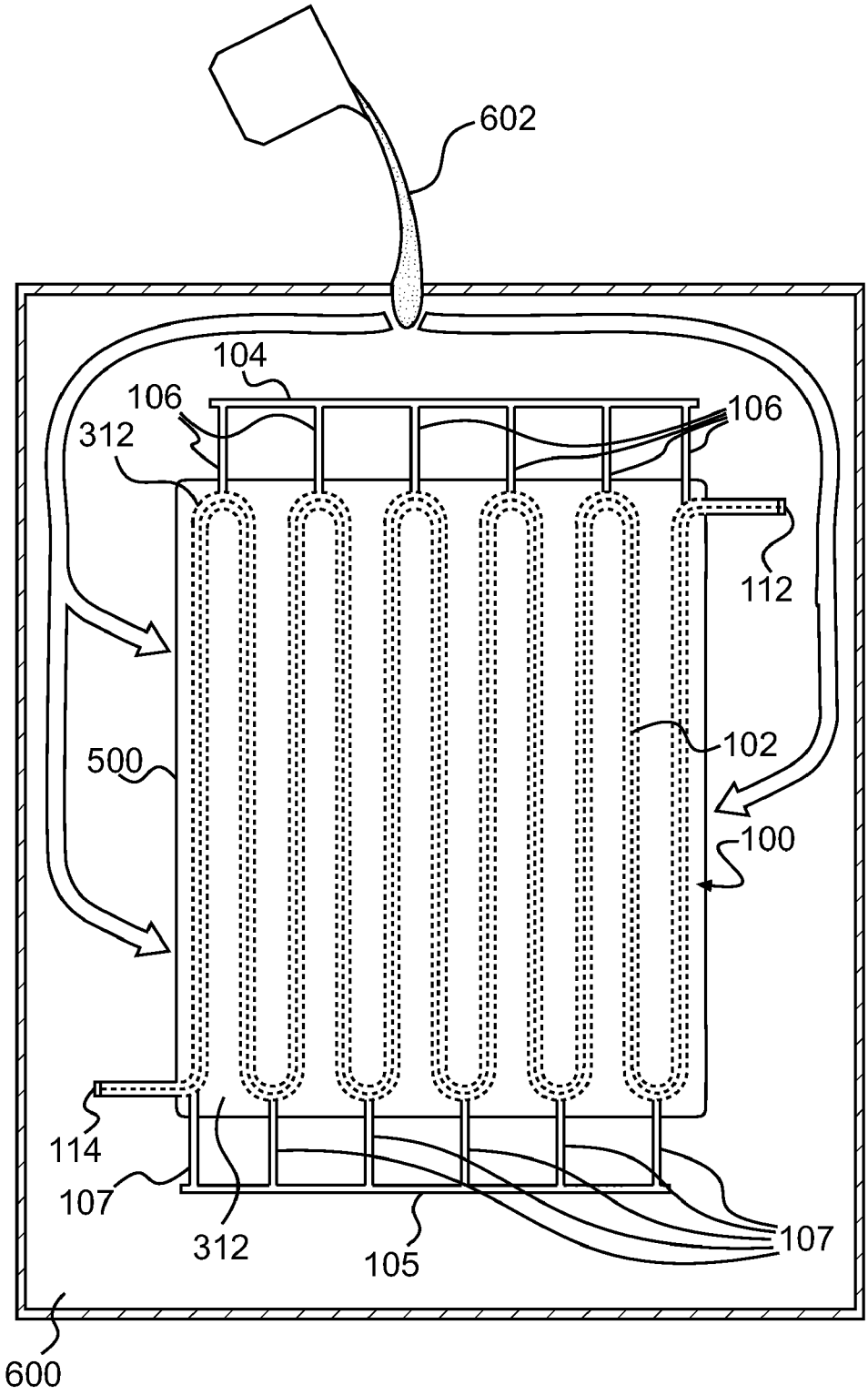
FIG. 6 is a cross-sectional plan view of a sand box containing the consumable pattern of FIG. 3.
Figure 7:
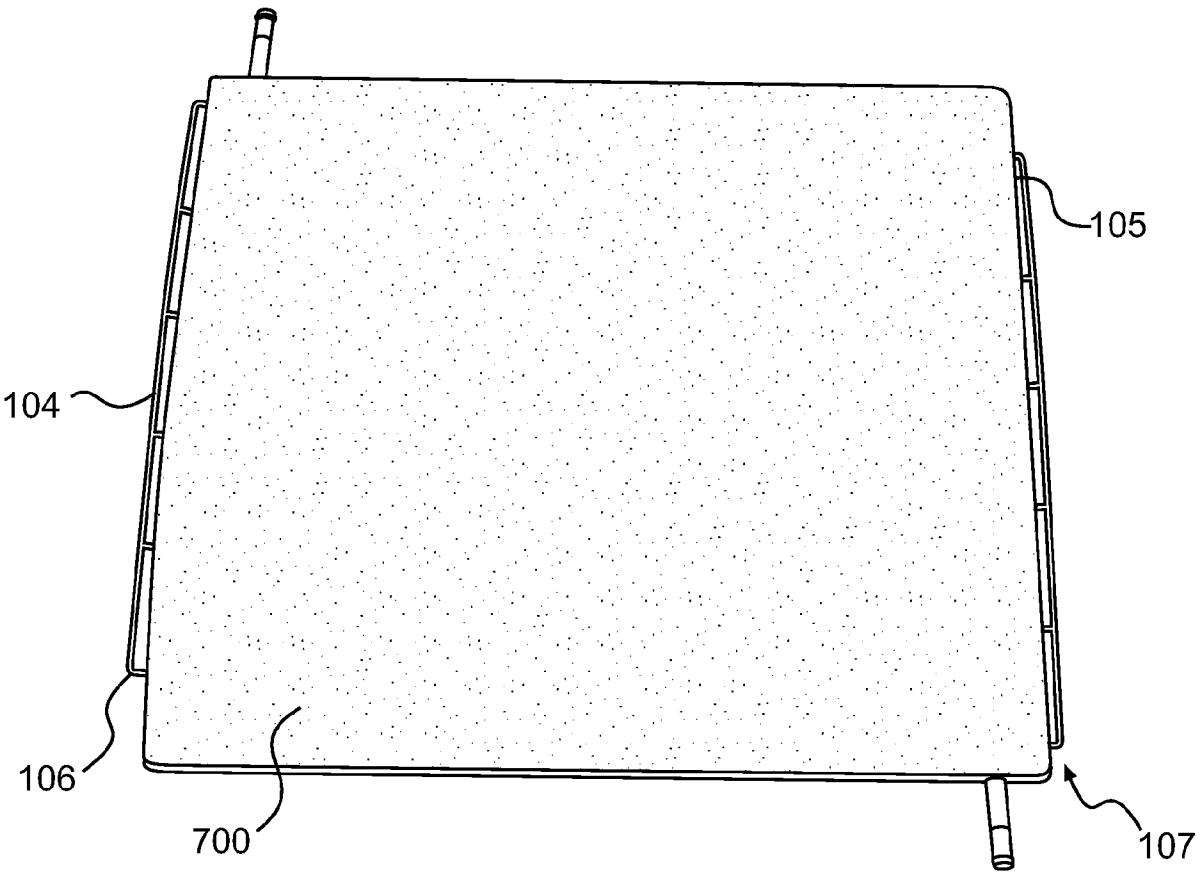
FIG. 7 is a plan view of a rough cooling plate.

Referring now to FIG. 6, a shell consisting of the refractory material 500 and a sand box 600 is formed by compacting sand around the foam pattern 312, in a conventional manner. The sand box 600 is formed of compacted loose non-bonded sand, and is permeable to foam vapor. The support bars 104, 105 are enclosed within the sand box 600. A casting material 602 is then poured into the foam pattern 312 in the interior of the sand box 600 via a gating system with the shell acting as a mold. The casting material 602 is preferably molten aluminum, although it should be understood that other casting materials may alternatively be used, provided the material of the mold core 100 is chosen such that the mold core 100 can withstand the temperature of the molten casting material 602. The heat of the molten casting material 602 vaporizes the foam pattern 312, and the vapor escapes through the refractory material 500 and the sand box 600, allowing the casting material 602 to occupy the volume previously occupied by the foam pattern 312. The permeability of the refractory material 500 is preferably controlled to allow the foam vapor to escape at a desired rate, thereby controlling the rate at which the casting material 602 is introduced into the mold. The casting material 602 is then allowed to cool to form a final casting in the form of a rough plate 700 (FIG. 7). The refractory material 500 prevents the casting material 602 from bonding to the sand, and gives the rough plate 700 a smoother surface, with the result that less subsequent machining is required. The positioning of the support bars 104, 105 outside the foam pattern 312 permits a relatively unobstructed path for the casting material 602 to completely fill the interior of the shell, without being obstructed by the support bars 104, 105. As a result, fewer porosity defects occur in the final casting, and fewer cast plates are discarded, resulting in savings of time cost and material waste. In addition, the support bars 104, 105 help maintain a precise positioning and alignment of the mold core 300, particularly when the mold core 300 is not supported by the foam pattern 312, which has been vaporized, or the casting material 602, which is still in liquid form. In this manner, the support bars 104, 105 and chaplets 106, 107 provide added rigidity to the mold core 100 without contributing significantly to scrap costs.

Figure 8:
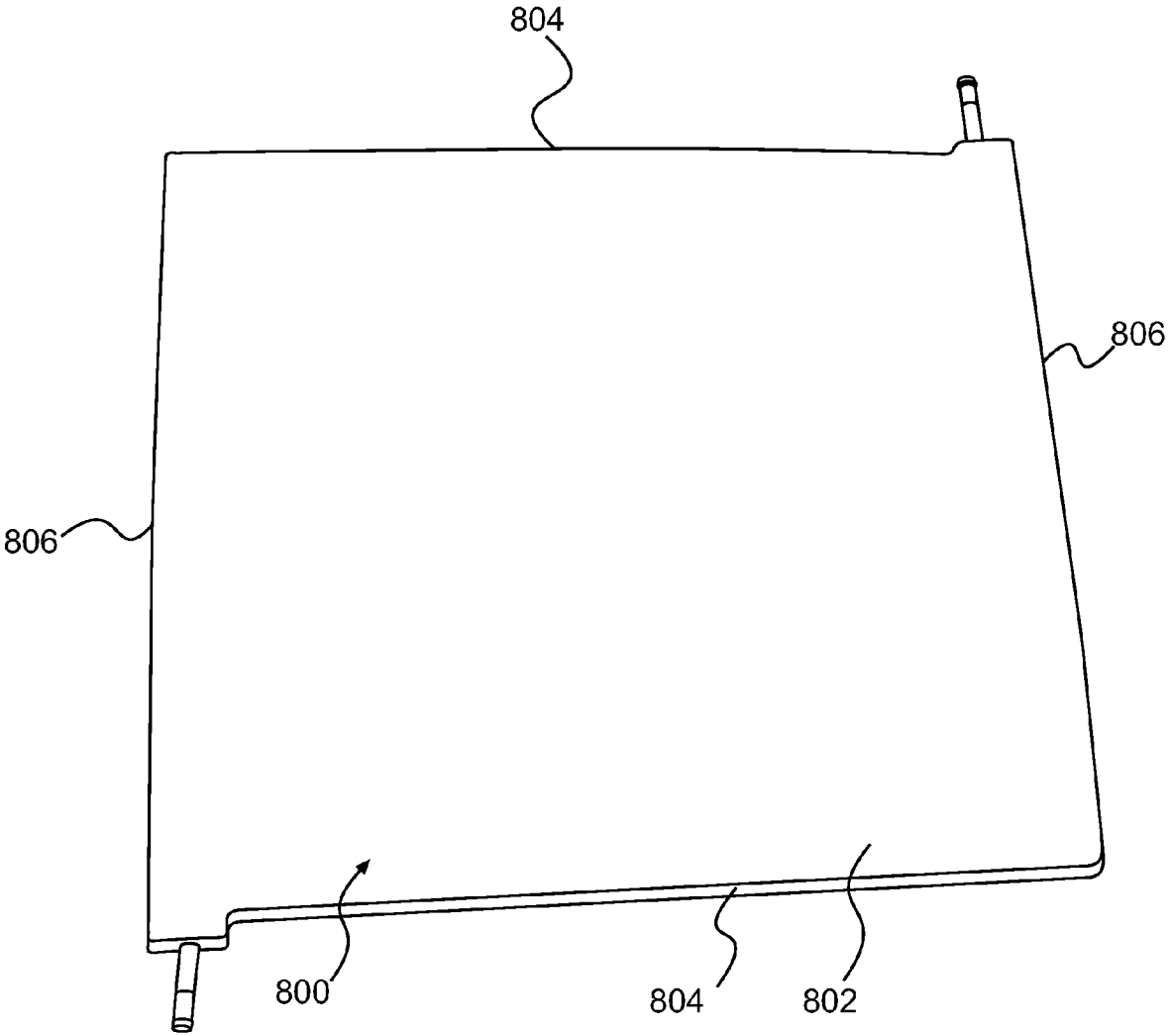
FIG. 8 is a plan view of a finished cooling plate.

Referring to FIG. 8, once the casting material 602 has cooled the casting is removed from the shell, and the rough plate 700 is machine finished to produce a final plate 800. The faces 802 and edges 804, 806 of the final plate 800 are machined smooth, and the support bars 104, 105 and a portion of the chaplets 106, 107 are removed in the process. Additional machining may be performed to make the final plate 800 more aesthetically appealing and provide improved thermal contact with the device to be cooled. The added rigidity and precision in positioning provided by the chaplets 106, 107 and the support bars 104, 105 during the casting process prevents deformation of the mold core 100 away from the plane 110, resulting in a more reliable clearance between the mold core 100 and the faces 802 of the final plate 800. The narrow clearance between the 6 mm outside diameter of the mold core 100 and the 8 mm thickness of the final plate 800 is such that even a small distortion of the mold core 100 can potentially be problematic. As a result of the added rigidity, the mold core 100 is less likely to have deformed to a position close to either face 802, and the machining of the face 802 is correspondingly less likely to damage or puncture the mold core 100. This further reduces the labor and material costs associated with scrapping damaged or unusable plates.

Figure 9:
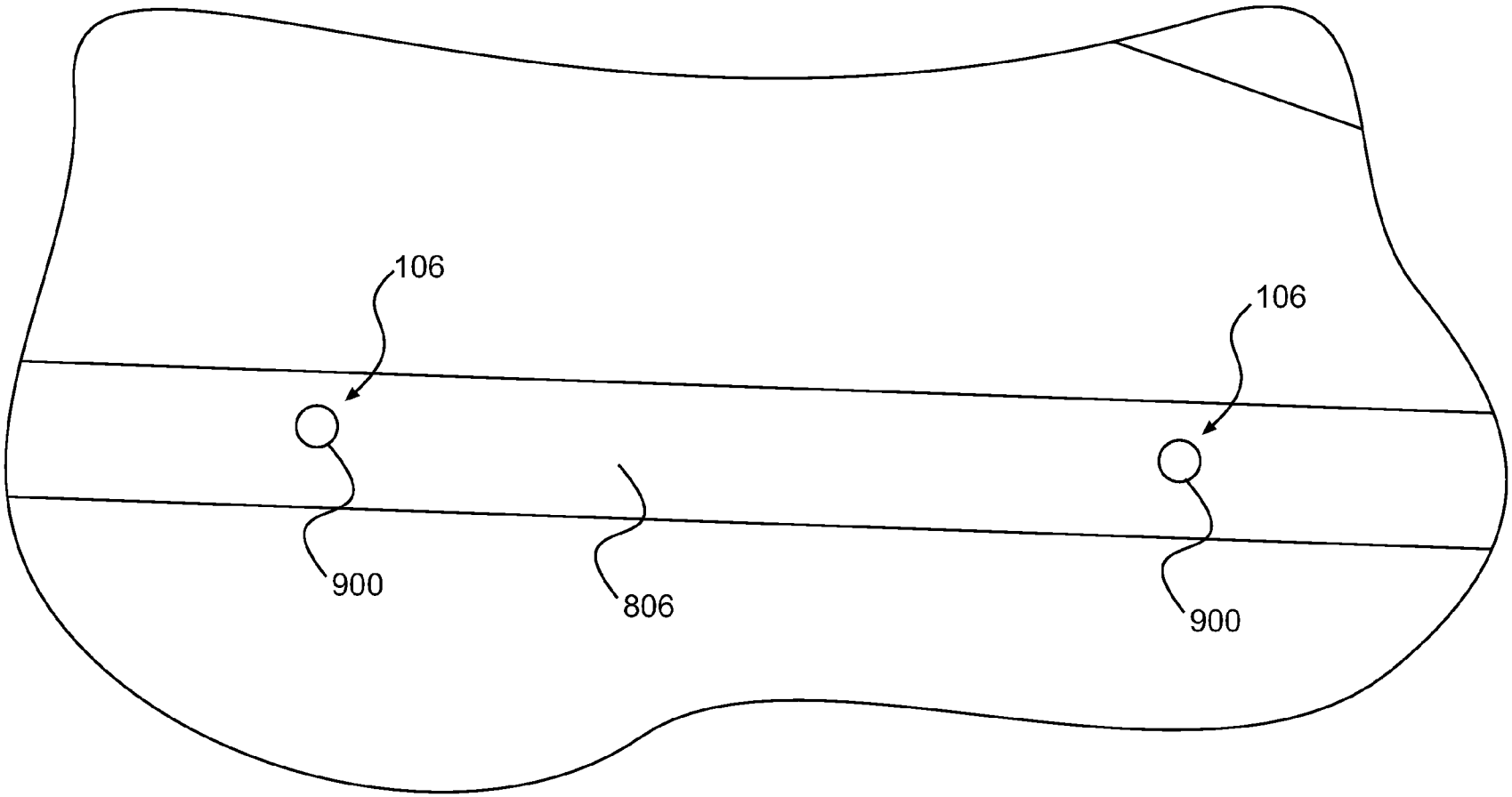
FIG. 9 is a perspective view of a portion of the finished cooling plate of FIG. 8, taken from a top, right side.

Referring to FIG. 9, a cross-section 900 of the steel chaplets 106 can be seen along the edge 806 of the finished plate, corresponding to locations where the chaplets 106 previously passed through the boundary of the rough plate 700 to connect the mold core 100 inside the rough plate 700 to the support bars 104, 105 outside the rough plate 700.

Figure 10:
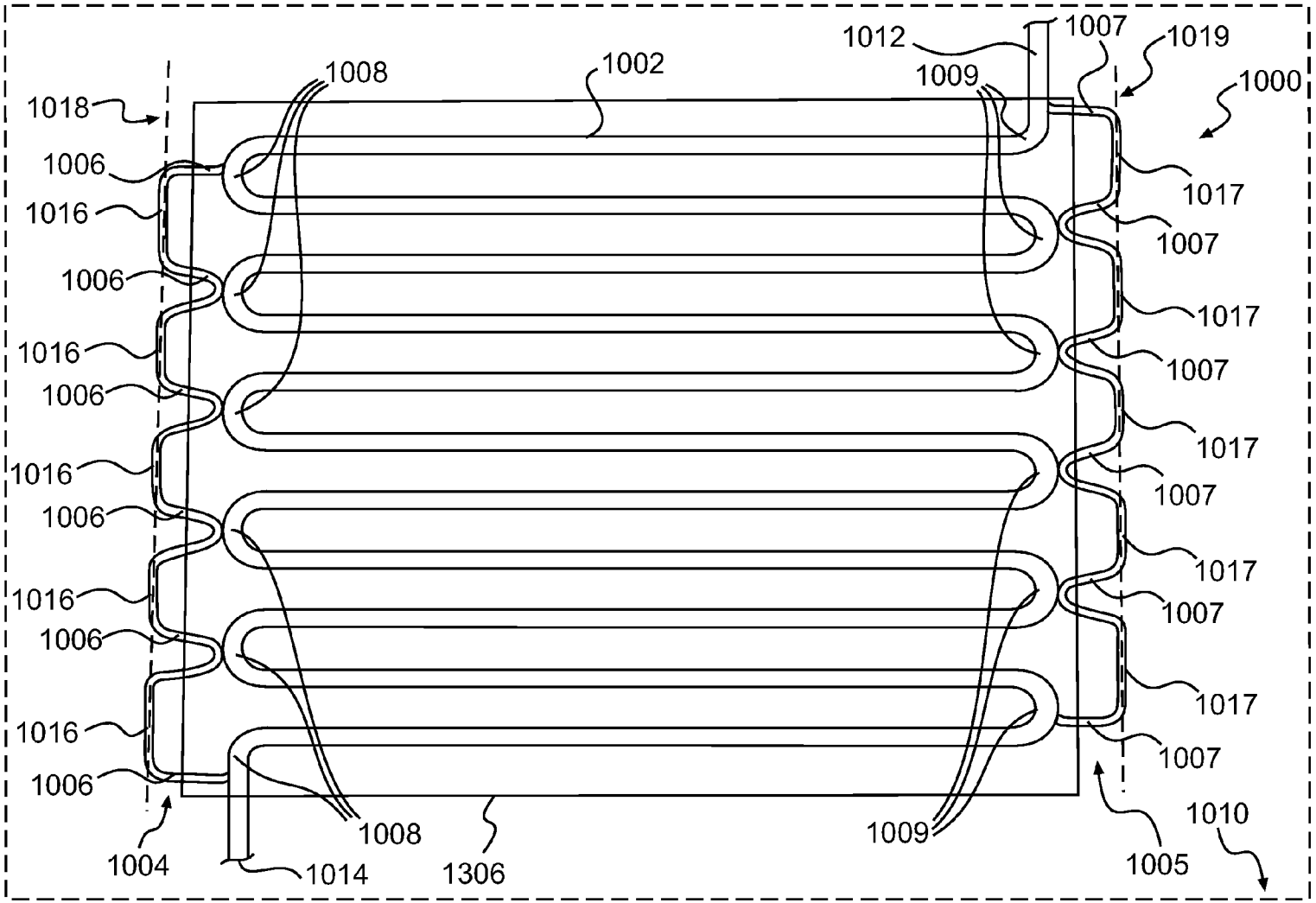
FIG. 10 is a plan view of a mold core assembly according to a second embodiment.

FIG. 10 shows a mold core 1000 that can be used in a cooling plate in accordance with a second embodiment.

The mold core 1000 consists of a hollow tube 1002, similar in construction to the hollow tube 102 of FIG. 2. The tube 1002 has a number of curved portions 1008, 1009 formed therein. The tube 1002 has an inlet 1012 and an outlet 1014. A first support member, in the form of a steel support bar 1004, has a plurality of generally co-axial first portions 1016 that lie generally on a common axis 1018. A plurality of linking portions 1006 extend away from the common axis 1018 in the direction of corresponding ones of the curved portions 1008. The linking portions 1006 are welded to the corresponding curved portions 1008. A second support member, in the form of a steel support bar 1005, has a plurality of generally co-axial first portions 1017 that lie generally on a common axis 1019. A plurality of linking portions 1007 extend away from the common axis 1019 in the direction of corresponding ones of the curved portions 1009. The linking portions 1007 are welded to the corresponding curved portions 1009. The linking portions 1006, 1007 may be formed in the support bars 1004, 1005 by any suitable method, such as by stamping a straight metal rod to achieve the desired shape. The first and second curved portions 1008, 1009 preferably lie in a common plane 1010 (parallel to the page of FIG. 10), which will have the same orientation as the final casting. It is preferred that each curved portion 1008, 1009 be fixedly connected to its corresponding support bar 1004, 1005, to ensure its stability against deformation during the casting process as described above. The inlet 1012 and the outlet 1014 fluidly communicate through the hollow interior of the tube 1002 to allow for coolant flow therethrough. While the tube 1002 has a generally circular cross-section, it is contemplated that other cross-sectional shapes may be used, such as a square cross-section. It is further contemplated that a solid tube may be used instead of a hollow tube, in which case the tube may be oxidized and removed from the final casting to create a curved channel.

The mold core 1000 is used in the casting process shown in FIGS. 3-9 in the same manner as the mold core 100 of FIG. 2. The size of the interior volume 1306 of the negative mold used with the mold core 1000, corresponding to the dimensions of the final casting, is shown in FIG. 10 for reference purposes.

It is contemplated that the above procedure may be adapted for the use of wax instead of foam as the consumable pattern material. It should be understood by a person skilled in the art that some modifications to the procedure may be required in the case of wax. The seal 314 may not be required as wax is less prone to leakage than foam. The refractory material 500 is a ceramic material that is generally applied in a number of layers, to produce a thick shell, eliminating the need for a sand box. The wax pattern is typically melted and drained from the shell prior to introducing the casting material 602. Further modifications may be apparent to a person skilled in the art.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A method of making a casting using a mold core and at least one support member, the at least one support member having at least one first portion and a plurality of second portions, the plurality of second portions being connected to the mold core, the method comprising:

positioning the mold core at least in part in a sealed interior volume of a negative mold;

positioning the at least one first portion of the at least one support member outside the interior volume;

positioning the plurality of second portions at least in part inside the interior volume;

introducing a consumable pattern material into the interior volume of the negative mold to create a consumable pattern, the mold core being disposed at least in part inside the consumable pattern, the at least one support member being disposed at least in part outside the consumable pattern;

removing the consumable pattern from the negative mold;

forming a shell around the consumable pattern; and introducing a casting material into an interior of the shell to create a final casting, the mold core being disposed inside the final casting, the at least one support member being disposed at least in part outside the final casting.

2. The method of claim 1, wherein:

the at least one first portion is at least one elongate member; and the plurality of second portions is a plurality of linking members connected to the elongate member.

3. The method of claim 2, further comprising:

forming the mold core from at least one hollow tube by forming at least one curved portion in the hollow tube;

connecting a first end of each of the one or more linking members to the at least one elongate member; and connecting a second end of each of the one or more linking members to a corresponding one of the at least one curved portion of the mold core.

4. The method of claim 1, wherein the mold core includes at least one hollow tube.

5. The method of claim 1, wherein the mold core includes stainless steel.

6. The method of claim 1, wherein the casting material includes aluminum.

7. The method of claim 4, wherein:

the at least one tube has a plurality of first curved portions and a plurality of second curved portions;

the at least one support member includes first and second support members;

the plurality of second portions of the first support member is a plurality of first linking members connected to corresponding ones of the first curved portions; and the plurality of second portions of the second support member is a plurality of second linking members connected to corresponding ones of the second curved portions.

8. The method of claim 7, wherein the plurality of first curved portions and the plurality of second curved portions lie in a common plane.

9. The method of claim 7, wherein connecting the first and second linking members to the first and second curved portions comprises welding the first and second linking members to the first and second curved portions.

10. The method of claim 7, wherein the negative mold has a parting plane, and wherein positioning the mold core in the negative mold includes aligning the common plane with the parting plane.

11. The method of claim 4, wherein:

the at least one tube has a plurality of first curved portions and a plurality of second curved portions;

the at least one support member includes first and second support members;

the first support member being an elongate first member, the at least one first portion of the first support member being a plurality of spaced-apart first co-axial portions; and the plurality of second portions of the first support member being a plurality of first linking portions intermediate the plurality of first co-axial portions, the plurality of first linking portions extending away from an axis of the first co-axial portions, each first linking portion being connected to a corresponding one of the plurality of first curved portions; and the second support member being an elongate second member, the at least one first portion of the second support member being a plurality of spaced-apart second co-axial portions; and the plurality of second portions of the second support member being a plurality of second linking portions intermediate the plurality of second co-axial portions, the plurality of second linking portions extending away from an axis of the second co-axial portions, each second linking portion being connected to a corresponding one of the plurality of second curved portions;

wherein positioning the plurality of first portions of the at least one support member outside the interior volume comprises positioning at least the plurality of first co-axial portions and the plurality of second co-axial portions outside the interior volume.

12. The method of claim 1, wherein:

the consumable pattern material is wax; and forming the shell around the consumable pattern comprises coating the consumable pattern with a refractory material.

13. The method of claim 1, wherein:

the consumable pattern material is foam; and forming the shell around the consumable pattern comprises coating the consumable pattern with a refractory material and compacting sand around the consumable pattern.

14. The method of claim 13, further comprising:

sealing the sealed interior volume with a heat-resistant sealing material prior to introducing the consumable pattern material.

15. The method of claim 14, wherein sealing the consumable pattern with a heat-resistant sealing material comprises at least partially enclosing the at least one support member inside the heat-resistant sealing material.

16. The method of claim 13, wherein the heat-resistant sealing material contains silicone.

17. The method of claim 1, further comprising detaching the at least one support member from the final casting.

* * * * *